United States Patent [19]

Jarvis

[11] 4,070,864

[45] Jan. 31, 1978

[54] ADJUSTABLE IRRIGATION DAM

[76] Inventor: Kenneth Jarvis, R.R. 2, Box 106, Ulysses, Kans. 67880

[21] Appl. No.: 755,678

[22] Filed: Dec. 30, 1976

[51] Int. Cl.[2] ..... E02B 7/20

[52] U.S. Cl. ..... 61/29

[58] Field of Search ..... 61/22, 27, 29, 12, 30

[56] References Cited

U.S. PATENT DOCUMENTS

| | | | |
|---|---|---|---|
| 1,058,289 | 4/1913 | Cadwallader | 61/29 |
| 1,784,955 | 12/1930 | Ballard | 61/29 |
| 2,729,944 | 1/1956 | Bentrup | 61/29 |
| 2,991,626 | 7/1961 | Browning | 61/29 |
| 3,355,896 | 12/1967 | Price | 61/29 |

*Primary Examiner*—Paul R. Gilliam
*Assistant Examiner*—David H. Corbin
*Attorney, Agent, or Firm*—Fishburn, Gold & Litman

[57] ABSTRACT

An adjustable portable irrigation dam for use in an irrigation ditch is operative to selectively raise the water level upstream of the dam thereby permitting removal of water for irrigation of crops. The dam includes an elongated sheet support member extending transversely across the irrigation ditch and being rotatably supported in members selectively positioned on opposite sides of said ditch to resist forces thereon so that rotation of said support member will selectively raise and lower one end portion of a sheet of a flexible material into and out of blocking relation to the irrigation ditch. Retaining mechanism is connected to the sheet support member for selectively retaining the support member and the flexible sheet in a selected position.

8 Claims, 5 Drawing Figures

1
2
3
5
6
8
9
10
11
12
13
16
19
21
24
25
29

1
2
3
4
5
6
11
12
14
15
16
18
19
20
24
3.
4.

2
3
5
7
9
10
19
29

5.
6
16
17
19
20
21
22
24
25
26
27
28

3
11
14
16
18
19
20
21
22
23
24
25
26

ADJUSTABLE IRRIGATION DAM

The present invention relates to portable, adjustable irrigation dams and more particularly to an adjustable irrigation dam having a rotatably mounted sheet support member with a sheet of flexible material attached thereto so that rotation of the sheet support member will selectively raise and lower portions of the sheet of flexible material into and out of blocking relation to the irrigation ditch.

The principal objects of the present invention are: to provide an improved portable irrigation dam for use in an irrigation ditch to permit control of the flow of water in the ditch so that lateral irrigation may be accomplished; to provide such an irrigation dam which will be adjustable in an easy and convenient manner to vary the depth of the water which is to be dammed up in the irrigation ditch; to provide such an adjustable irrigation dam which is a simple and efficient device for use with an impervious flexible sheet of material positioned to permit adjustable dam height yet stored with or without the dam sheet for transportation and storage; to provide such an adjustable irrigation dam wherein rotation of a sheet support member winds portions of the flexible sheet therearound to vary the elevation of a portion of the sheet an thereby vary the level of the water surface of the water upstream from the sheet; and to provide such an adjustable irrigation dam wherein the irrigation dam may be easily and quickly set up and removed, which is economical to manufacture, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the adjustable irrigation dam.

Figure 1:
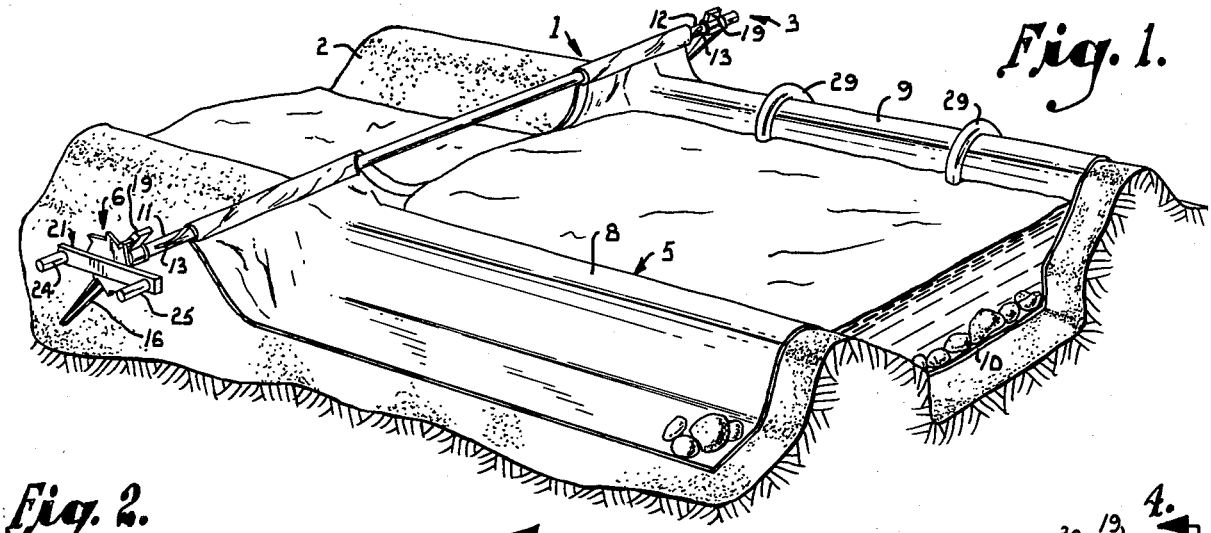
FIG. 1 is a perspective view of an irrigation ditch having therein an adjustable irrigation dam embodying features of the present invention.
Figure 2:
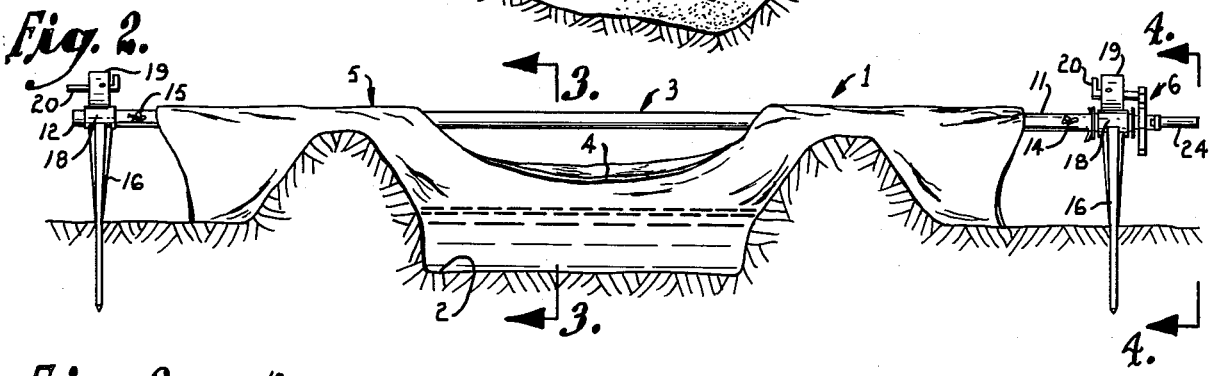
FIG. 2 is a front elevational view of the adjustable irrigation dam.
Figure 3:
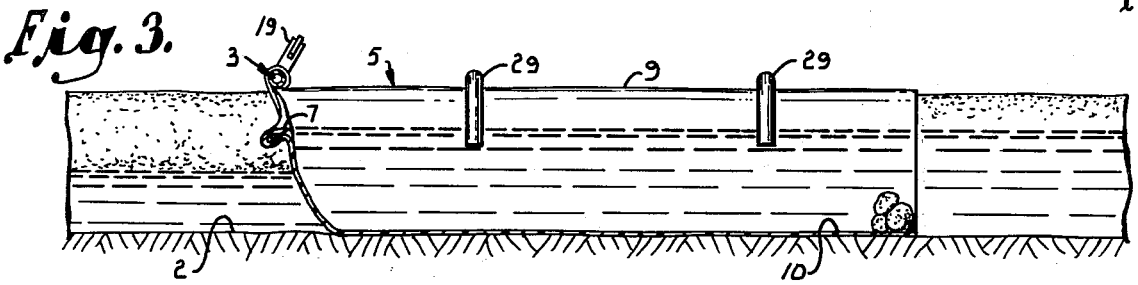
FIG. 3 is a transverse sectional view through the dam taken on line 3—3 of FIG. 2 and showing sheet material of the dam being held in the ditch.
Figure 4:
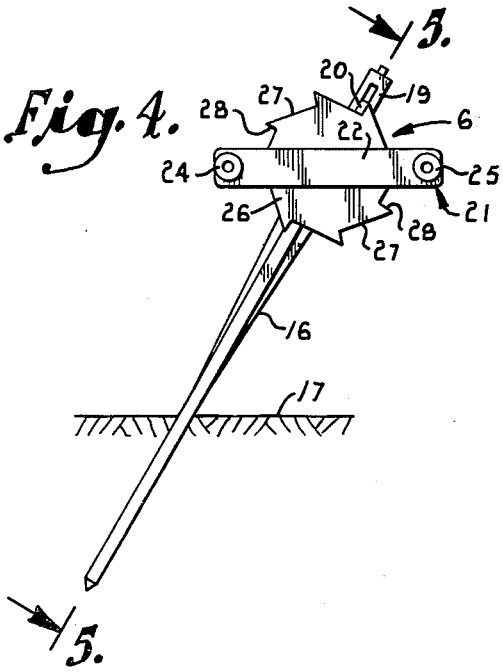
FIG. 4 is an enlarged fragmentary transverse sectional view taken on line 4—4 of FIG. 3 and showing ratchet means for retaining the sheet support member against rotation.
Figure 5:
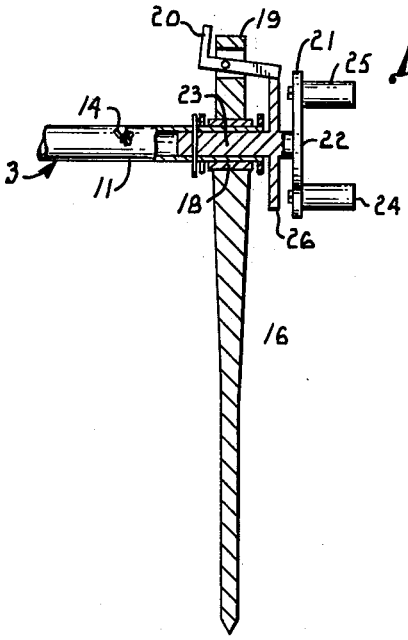
FIG. 5 is an enlarged fragmentary longitudinal sectional view taken on line 5—5 of FIG. 4 and showing a standard for rotatably supporting one end portion of a sheet support member.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally an adjustable and portable irrigation dam for use in an irrigation ditch 2 and operative to selectively raise the water level upstream of the dam 1 thereby permitting removal of water for irrigation of crops. The irrigation dam 1 includes an elongated sheet support member 3 extending transversely across the irrigation ditch 2 and being rotatably supported so that rotation thereof will selectively raise and lower a mid portion of one end portion 4 of a sheet 5 of flexible material into and out of blocking relation to the irrigation ditch 2. A ratchet 6 is connected to the sheet support member 3 and is operative to selectively retain the one end portion 4 of the flexible sheet 5 in a selected position by retaining the sheet support member 3 against rotation.

The flexible sheet 5 is formed of any suitable, durable and waterproof material, such as canvass, rubber, plastic, or the like. The one end portion 4 is folded to form a hem 7 extending the length thereof and having open opposite ends. The sheet 5 is preferably of a width so that opposite side edge portions 8 and 9 thereof overlap respective opposite banks of the irrigation ditch 2. The sheet 5 extends longitudinally along the irrigation ditch 2 and has suitable weights on the opposite end portion 10, as is conventional, to retain the sheet 5 in position in the ditch 2.

The sheet support member 3 is illustrated as an elongated rod or shaft having a length so that it extends transversely across the irrigation ditch 2 and has opposite end portions 11 and 12 extending beyond the side edge portions 8 and 9 respectively of the flexible sheet 5 and beyond the opposite banks of the ditch 2.

Rotation of the sheet support member 3 effects selective raising and lowering of the sheet portion 4 thereby varying the elevation of the sheet portion 4 and the water level upstream from the dam 1. In the illustrated embodiment, an elongated flexible member 13 extends through and beyond the hem 7 formed on the one end portion 4 of the flexible sheet 5. The flexible member 13 has opposite end portions 14 and 15 thereof suitably connected to the opposite end portions 11 and 12 respectively of the sheet support member 3, the spacing between the portions 11 and 12 being greater than the width of the ditch. Rotating the sheet support member 3 winds or unwinds the flexible member end portions 14 and 15 around or from the respective end portions of the sheet support member 3 and thereby winds or unwinds the respective portions of the flexible sheet one end portion 4 around or from the sheet support member 3.

In the illustrated embodiment, the flexible member end portions 14 and 15 extend through respective transverse passages or apertures in the sheet support member end portions 11 and 12. A suitable knot is tied in the free end of each flexible member end portion and is engageable with the sheet support member 3 to retain the flexible member 13 on the sheet support member 3.

The irrigation dam 1 includes means in engagement with at least one end portion of the sheet support member 3 for rotatably supporting same. In the illustrated embodiment, a standard 16 is supported on a ground surface 17 and extends upwardly therefrom. The standard 16 includes a sleeve portion 18 positioned adjacent an upper end portion 19 thereof. A latch member 20 is pivotally mounted on the standard upper end portion 19, for a purpose later described. In the illustrated structure, the latch member 20 is positioned on the longitudinal axis of the standard 16 and is positioned above the sleeve portion 18 of the standard 16. The latch member 20 is mounted in a suitable aperture or passage through the standard upper end portion 19.

A handle 21 is connected to the sheet support member 3 for rotating same to wind the flexible member end portions 14 and 15 therearound and the respective portions of the sheet one end portion 4 around the sheet support member 3 and thereby vary the elevation of the sheet one end portion 4. The handle 21 includes a body portion 22 and a shaft portion 23 extending therefrom and received in the sleeve portion 18 of the standard 16. The shaft portion 23 is received in and has one of the opposite end portions, for example end portion 11, of the sheet support member 3 connected thereto, as by a cotter pin.

The illustrated handle body portion 22 is a bar having gripping portions 24 and 25 on opposite ends of the body portion 22 so that the handle 21 may be gripped by both hands of an operator during adjustment of the elevation of the one end portion 4 of the flexible sheet 5.

The irrigation dam 1 includes means on the handle 21 and on the standard 16 for selectively retaining the sheet support member 3 against rotation and thereby positioning the sheet one end portion 4 at a selected elevated position. In the illustrated embodiment, the ratchet 6 includes the latch member 20 on the standard 16 and a ratchet wheel 26 mounted on the shaft portion 23 of the handle 21 and having a plurality of ratchet teeth on a peripheral edge thereon. The ratchet teeth each have a cam surface 27 and an abutment surface 28, each engageable by the latch member 20.

The latch member 20 is manually movable out of engagement with a respective one of the abutment surfaces 28 to thereby allow the sheet support member 3 to rotate to unwind and lower the sheet one end portion 4 and thereby selectively lower the surface of the water stream of the irrigation dam 1.

It is preferred that at least one end of the support member 3 be rotatably mounted in a standard 16 and that the elongated member thereof be supported on the ground and positioned at a suitable angle to resist any forces acting on the dam to thereby aid in retaining the dam against the water pressure or other forces acting thereon.

In using an irrigation dam constructed as illustrated and described, the flexible sheet 5 is positioned in the irrigation ditch 2 so that the side edge portion 8 and 9 thereof are overlying the respective banks of the ditch 2. At least one standard 16 is supported on the ground surface 17 and preferably extends upwardly from the ground surface 17 and is inclined in an upstream direction. The handle 21 is mounted on one standard 16 and the one end portion 11 of the sheet support member 3 receives therein and is connected to the shaft portion 23 of the handle 21. The sheet support member 3 is then rotated by the handle 21 thereby winding the flexible member 13 and the sheet hem 7 around the sheet support member 3 moving the sheet longitudinally along the irrigation ditch 2. Suitable weights, such as rock, concrete block, or the like, are then placed on the opposite end portion 10 of the sheet 5 and the sheet support member 3 is turned or rotated in the opposite direction thereby lowering the mid portion of the one end portion 4 of the sheet 5 and allowing flow thereover until it is desired to use the dam 1 for increasing the depth of water upstream thereof. The water upstream of the dam 1 can be directed into small lateral ditches between rows of plants and thereby accomplish efficient irrigation. One manner of conducting water from the dammed up water upstream of the dam may be by one or more siphon pipes 29, as shown in FIG. 1 thereby avoiding the need to cut either of the irrigation banks. When it is desired to move the dam 1 from one location to another, it is preferred that the sheet 5 be rolled around the sheet support member 3 so that the sheet support member 3, sheet 5, and standard 16 may be easily moved to a new location in the same ditch 2 or in another irrigation ditch 2. It is a simple process to remove the dam 1 from the ditch 2 and store same. The flexible manner 13 is disconnected from the sheet support member 3 and removed from the hem 7. The handle 21 is disconnected from the sheet support member 3. The flexible sheet 5 is removed from the ditch and allowed to dry and then folded for storage.

It is to be understood that while I have illustrated and described one form of my invention, it is not to be limited to the specific form or arrangement of parts herein described and shown.

What I claim and desire to secure by Letters Patent is:

1. An adjustable irrigation dam comprising:

a. a sheet of flexible material capable of being positioned in transverse blocking relation to an irrigation ditch, said sheet having opposite end portions and a width greater than the width of such ditch whereby side margins overlie areas outwardly of said ditch;

b. an elongated shaft member extending transversely across the irrigation ditch and having opposite end portions positioned laterally outwardly of the ditch;

c. means connecting portions of side margins of said sheet and spaced apart portions at one of the opposite end portions thereof of said shaft member at points adjacent the sides of the ditch for permitting a mid portion between said portions of the side margins of said sheet to sag downwardly from said elongate shaft and permitting said sheet one end portion to be wound around said elongate shaft member upon rotation thereof to raise and lower said mid portion;

d. anchor means selectively positioned on one side of and outwardly of the ditch and in engagement with one of the opposite end portions of said elongate shaft member for rotatably supporting same and retaining in a selected position relative to the ditch;

e. a handle connected to said elongate shaft member adjacent said anchor means for rotating same to wind said portions the side margins of said sheet one end portion around said elongate shaft and vary the elevation of said mid portion of said sheet one end portion between said side margin portions connected thereto; and f. means on said handle and on said anchor means for selectively retaining said elongate shaft member against rotation and thereby position said mid portion of said sheet one end portion between said side margins at a selected elevated position.

2. An adjustable irrigation dam as set forth in claim 1 wherein:

a. said anchor means includes a standard extending upwardly from a ground surface and having a sleeve portion adjacent an upper end portion thereof; and b. said handle and connector thereof to said elongate shaft member includes a stub shaft portion extending from said handle and received in said sleeve portion of said standard and having one end portion of said elongate shaft member connected thereto.

3. An adjustable irrigation dam as set forth in claim 2 wherein said means for selectively retaining said elongate shaft member against rotation includes:

a. a ratchet wheel mounted on said shaft portion of said handle and having a plurality of ratchet teeth on a peripheral edge thereof with said teeth having abutments facing in one direction and inclined surfaces facing the other; and b. a latch member pivotally mounted on said standard and engageable with said ratchet teeth abutments to permit rotation to raise the mid portion of said sheet and prevent rotation of the lower said mid portion of the sheet during engagement of said latch member with said abutments.

4. An adjustable irrigation dam as set forth in claim 1 wherein said means for connecting said side margins of said sheet one end portion to said elongate shaft member includes:

a. means on said sheet one end portion defining a hem having open opposite ends; and b. an elongate flexible member extending through said hem and beyond said hem opposite ends and having opposite end portions thereof each connected in fixed relation to portions of said elongate shaft member at points having less spacing than the length of the hem to permit the sheet member therebetween to sag downwardly from the support member a desired amount for flow of water over the mid portion thereof.

5. An adjustable irrigation dam comprising:

a. a sheet of flexible material capable of being positioned in transverse blocking relation to an irrigation ditch, said sheet having opposite end portions and a hem formed in one of said opposite end portions and having open opposite ends, said sheet having a width greater than the widthh of such ditch whereby side margins overlie areas laterally outwardly of said ditch;

b. an elongated shaft member extending transversely across the irrigation ditch and having opposite end portions positioned laterally outwardly of the ditch;

c. an elongated flexible member extending through said hem and beyond said hem opposite ends and having opposite end portions thereof each connected to respective spaced portions of said elongate shaft member adjacent sides of the ditch with a spacing less than the width of the sheet;

d. anchor means selectively positioned at a side of the ditch and outwardly thereof and in engagement with at least one of the opposite end portions of said elongate shaft member for rotatably supporting same;

e. a handle connected to said elongate shaft member for rotating same to wind said elongated flexible member end portions around said elongate shaft member and thereby wind spaced apart portions of said one end portion of said sheet around said elongate shaft member to vary the elevation of a mid portion between said spaced apart portions of said sheet one end portion; and f. ratchet means on said handle and on said anchor for selectively retaining said elongate shaft member against rotation and thereby position said mid portion between said spaced portions of said sheet one end portion at a selected elevated position, said ratchet means being releasable to allow said elongate shaft member to rotate and lower said mid portion of said sheet one end portion.

6. An adjustable irrigation dam as set forth in claim 5 wherein:

a. said anchor means for rotatably supporting said sheet support member includes a standard extending upwardly from a ground surface and having a sleeve portion adjacent an upper end portion thereof; and b. said handle and connection includes a stub shaft portion extending therefrom and received in said sleeve portion of said standard and having one end portion of said elongate shaft member connected thereto.

7. An adjustable irrigation dam as set forth in claim 5 wherein said ratchet means includes:

a. a ratchet wheel mounted on said stub shaft portion of said handle and having a plurality of ratchet teeth on a peripheral edge thereof, said teeth each having a cam surface and an abutment surface; and b. a latch member pivotally mounted on said standard upper end portion and engageable with said abutment surface of said ratchet teeth.

8. An adjustable irrigation dam as set forth in claim 7 wherein:

a. said anchor means for rotatably supporting said sheet support member includes a standard extending upwardly from a ground surface and having a sleeve portion adjacent an upper end portion thereof;

b. said latch member is pivotally mounted on said standard upper end portion and positioned above said sleeve portion of said standard; and c. said handle and connection includes a stub shaft portion extending therefrom and received in said sleeve portion of said standard and having one end portion of said elongate shaft member connected thereto.

* * * * *